US005447461A

United States Patent [19]

Liao

[11] Patent Number: 5,447,461

[45] Date of Patent: Sep. 5, 1995

[54] SOUND GENERATING HAND PUPPET

[76] Inventor: Fu-Chiang Liao, c/o Hung Hsing Patent Service Center P.O. Box 55-1670, Taipei, Taiwan

[21] Appl. No.: 326,842

[22] Filed: Oct. 21, 1994

[51] Int. Cl.[6] ..... A63H 3/28; A63H 3/14

[52] U.S. Cl. ..... 446/301; 446/329

[58] Field of Search ..... 446/301, 339, 329, 184, 446/193

[56] References Cited

U.S. PATENT DOCUMENTS 3,916,537 11/1975 Gilligan et al. ..... 446/329 X
4,687,457 8/1987 Milner ..... 446/329 X
5,290,198 3/1994 Nakayama ..... 446/301 X

FOREIGN PATENT DOCUMENTS 2643283 8/1990 France ..... 446/184

*Primary Examiner*—Mickey Yu

[57] ABSTRACT

A hand puppet includes: a puppet glove to be worn by a player hand, a mouth-manipulating device secured in a head portion of the puppet glove having a mandible plate embedded in a lower-jaw sheath of a mouth portion of the puppet glove and a maxilla plate embedded in an upper-jaw sheath of the mouth portion of the puppet glove, and a sound generator mounted in the mouth-manipulating device, whereby upon pivoting of the maxilla plate about the mandible plate to open the upper-jaw sheath to actuate the sound generator, a sound may be produced from the sound generator for imitating an animal or man's cry or singing for increasing a player's interest.

4 Claims, 4 Drawing Sheets

SOUND GENERATING HAND PUPPET

BACKGROUND OF THE INVENTION

A conventional hand puppet such as for animating a man or an animal may be worn on a man's hand by inserting his fingers to an upper jaw sheath and inserting his thumb to a lower jaw sheath for pivoting the upper jaw and lower jaw sheath for opening or closing the puppet mouth for playing purpose. However, such a conventional hand puppet can not produce audible sound during manipulation for opening or closing the puppet mouth, thereby lacking of playing interest.

SUMMARY OF THE INVENTION

The object of the present invention is to provide a hand puppet including: a puppet glove to be worn by a player's hand, a mouth-manipulating device secured in a head portion of the puppet glove having a mandible plate embedded in a lower-jaw sheath of a mouth portion of the puppet glove and a maxilla plate embedded in an upper-jaw sheath of the mouth portion of the puppet glove, and a sound generator mounted in the mouth-manipulating device, whereby upon pivoting of the maxilla plate about the mandible plate to open the upper-jaw sheath to actuate the sound generator, a sound may be produced from the sound generator for imitating an animal or man's cry or singing for increasing a player's interest.

DETAILED DESCRIPTION

Figure 1:
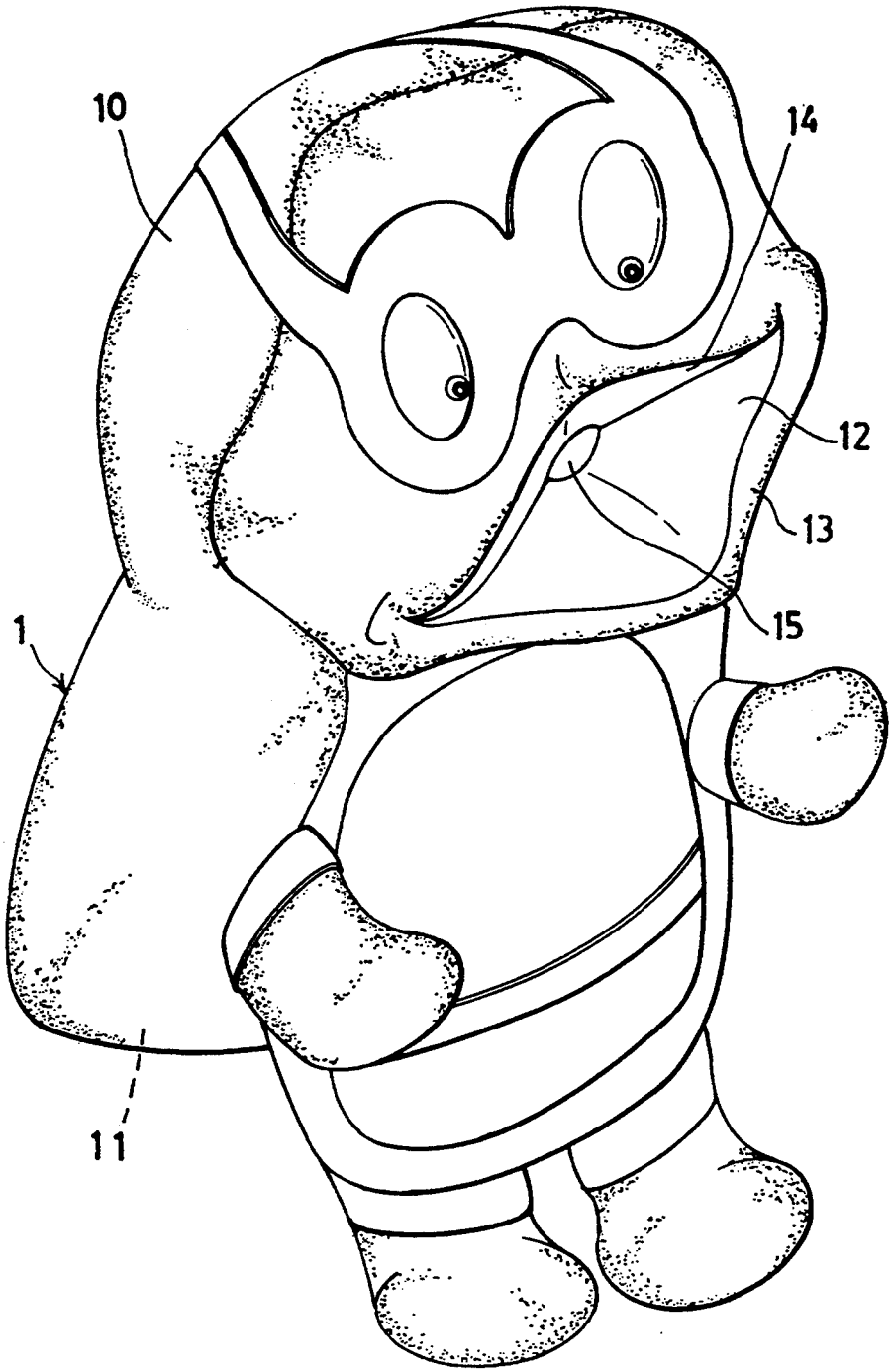
FIG. 1 is a perspective view of an animal puppet of the present invention.
Figure 2:
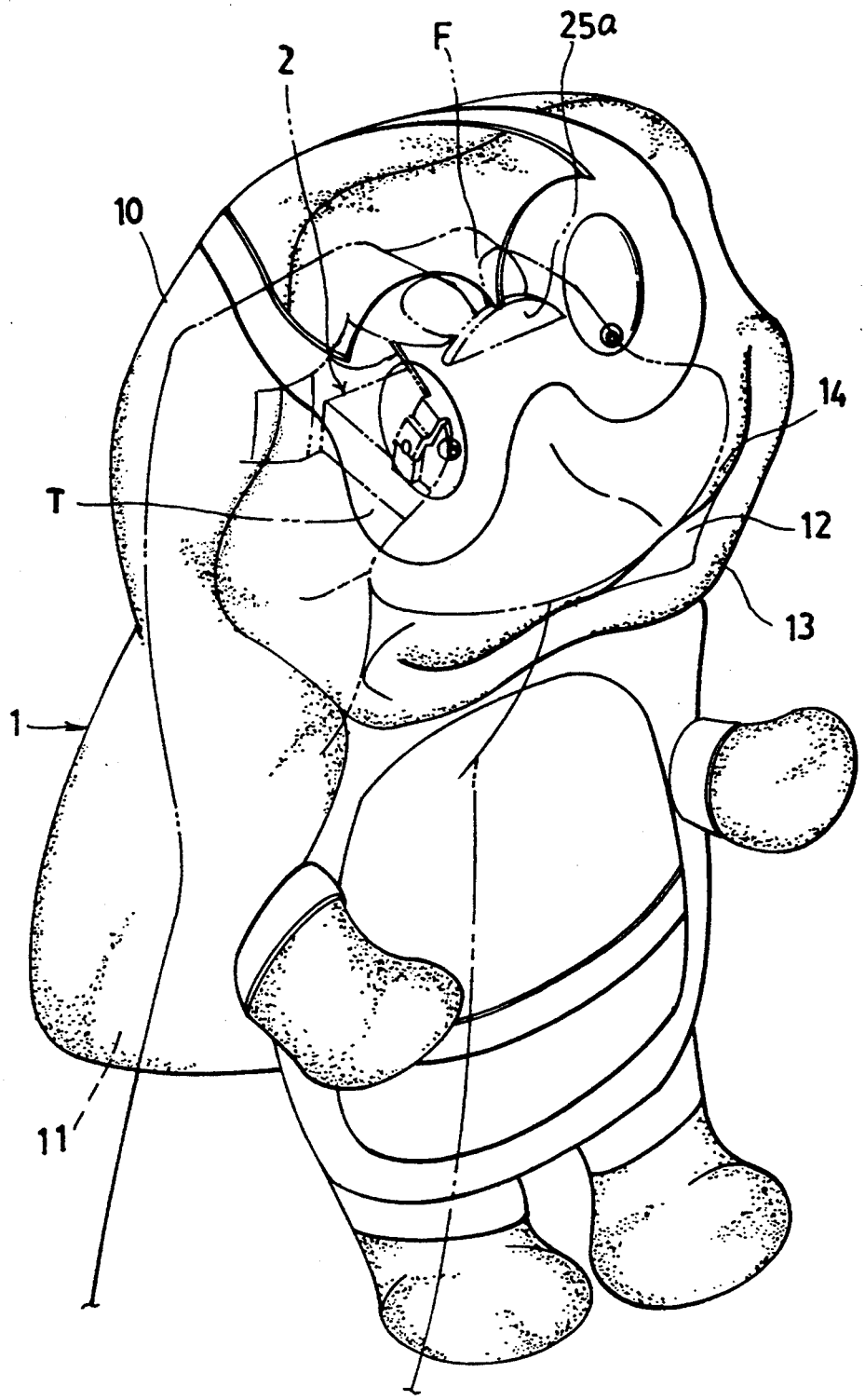
FIG. 2 is a perspective view showing a puppet manipulated by a hand in accordance with the present invention.

As shown in the drawing figures, the present invention comprises: a puppet glove 1, a mouth manipulating means 2, and a sound generating means 3.

The puppet glove 1 includes: a main socket 11 recessed inwardly in the puppet glove 1 to be worn by a player's hand, a mouth portion 12 formed on a head portion 10 of the puppet glove 1 having a lower-jaw sheath 13 and an upper-jaw sheath 14 pivoting with each other, and a throat 15 formed in a central portion of the mouth portion 12. Both the sheaths 13, 14 are communicated with the main socket 11 for an insertion of the fingers F into the upper-jaw sheath 14 and insertion of thumb T into the lower-jaw sheath 13.

The mouth manipulating means 2 includes: a thumb-operated base portion 21 having a mandible plate portion 22 protruding forwardly from the base portion 21 to be embedded in the lower-jaw sheath 13 of the puppet glove 1 and having a housing 20 secured with the base portion 21 for storing the sound generating means 3 in the housing 20, a finger-operated member 23 pivotally secured to the thumb-operated base portion 21 and having an upper depression portion 25 formed on a rear portion of the finger-operated member 23 and having a maxilla plate portion 26 protruding forwardly from the upper depression portion 25 to be embedded in the upper-jaw sheath 14, a knob portion 27 protruding downwardly from a rear bottom portion of the upper depression portion 25 of the finger-operated member 23, and a restoring spring 28 resiliently retained between the maxilla plate portion 26 and the mandible plate portion 22 normally restoring the maxilla plate portion 26 to be closed upon the mandible plate portion 22 for normally closing the upper-jaw sheath 14 on the lower-jaw sheath 13 for closing the mouth portion 12 of the puppet glove 1. A retarding plate **25*a* is formed on the depression portion 25 for an ergonomic depressing operation for opening the mouth portion 12**.

The sound generating means 3 includes: a trigger switch 31 resiliently mounted on the housing 20 of the mouth manipulating means 2, a sound-producing integrated circuit 32 electrically connected to the trigger switch 31 and a power source of batteries (not shown) for generating sound such as for imitating or producing an animal cry, shouting, singing or even a human voice, and a speaker 33 electrically connected to the sound-producing integrated circuit 32 for amplifying the sound produced by the integrated circuit 32.

The sound produced in this invention is not limited, depending upon the programming of the integrated circuit 32. Also, the puppet glove may be formed to be any shapes for imitating or making animals, dolls, or soft toys, not limited in this invention.

The finger-operated member 23 includes a pair of lugs 24 formed on two opposite side portions of a middle portion of the finger-operated member 23 to be pivotally securable with a pair of pins 211 formed on two opposite side portions of the thumb-operated base portion 21 for pivoting the finger-operated member 23 on the thumb-operated base portion 21.

The mandible plate portion 22 may be secured with the lower-jaw sheath 13 by a fastening means 221 such as adhesive bonding or other methods; and the maxilla plate portion 26 may also be secured to the upper-jaw portion 14 by a fastening means 261 such as by adhesive bonding or other securing methods.

The base portion 21 may be drilled with a plurality of perforations 212 therein for outwardly transmitting sound from the speaker 33 through the throat 15 formed in the mouth portion 12 of the puppet glove 1.

Figure 3:
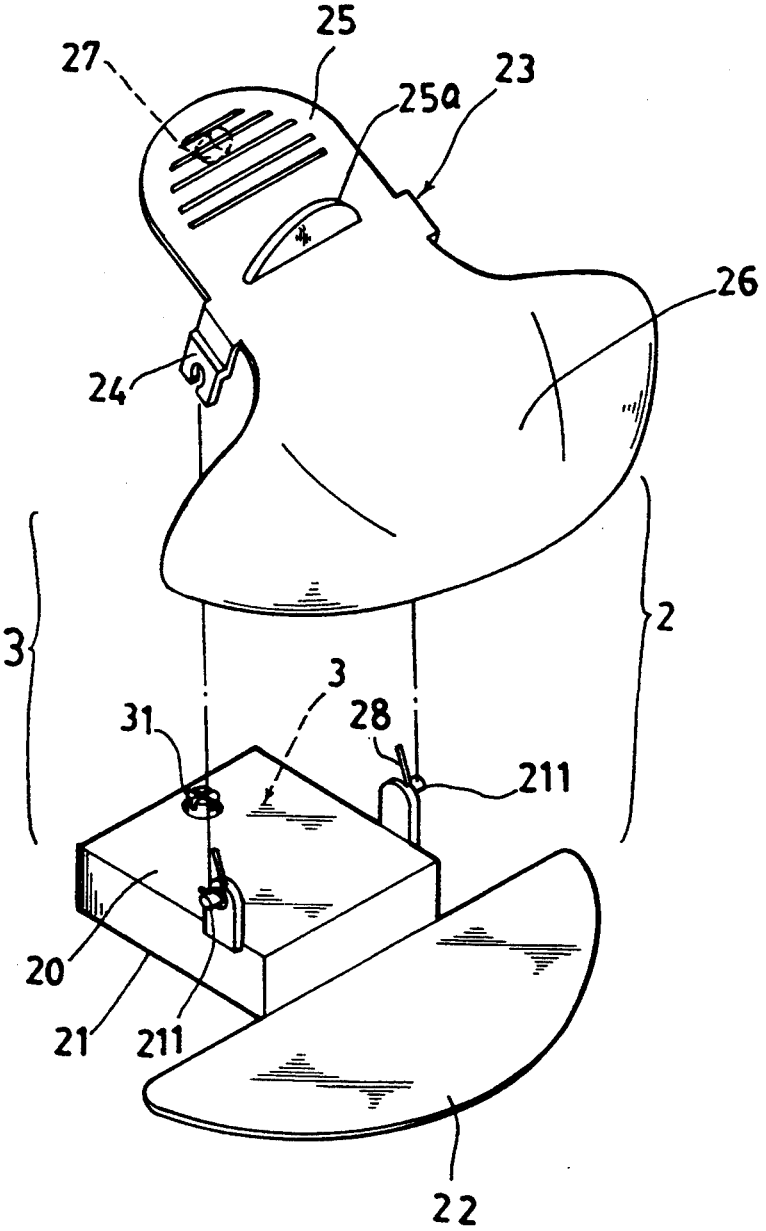
FIG. 3 is an exploded view of a mouth manipulating means of the present invention.

Either the maxilla plate portion 26 or the mandible plate portion 22 may be formed as a wedge or triangular shape as shown in FIG. 3 to animate an animal such as a frog or the like.

The restoring spring 28 may be replaced by a rubber or elastic band (as shown in dotted line of FIG. 4) fastening the maxilla plate portion 26 with the mandible plate portion 22 for normally closing the mouth portion 12 of the puppet glove 1.

Figure 4:
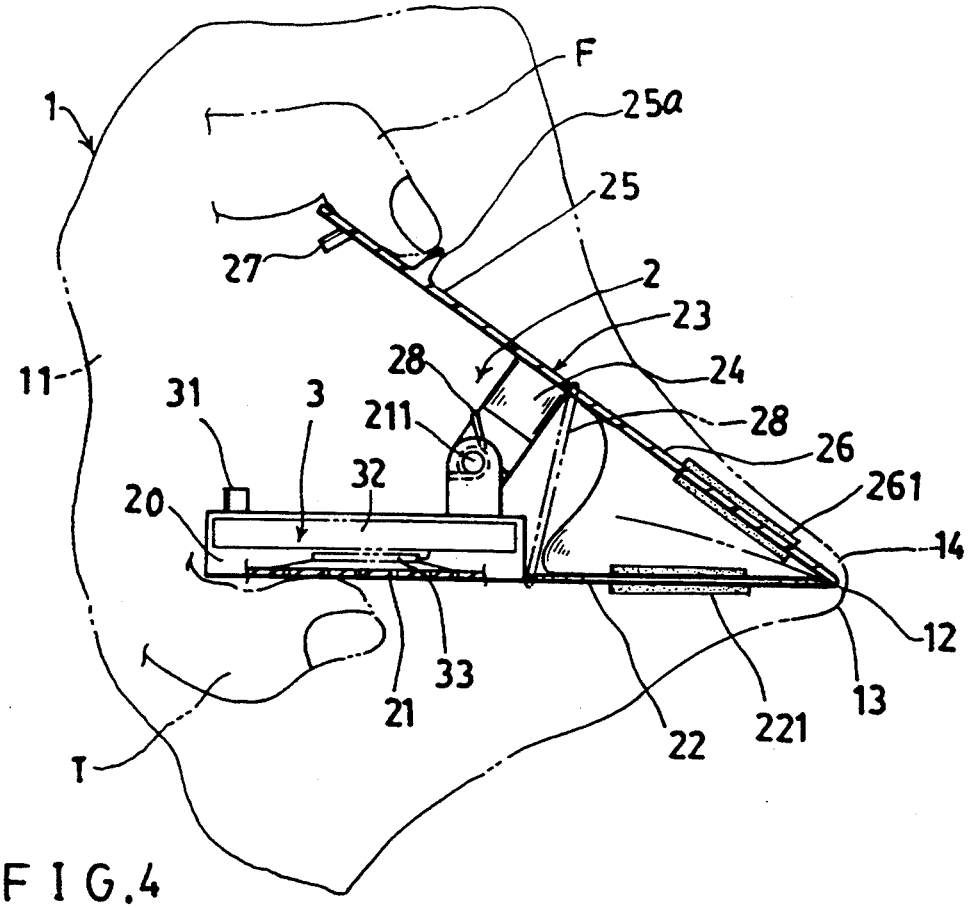
FIG. 4 is a partial sectional drawing showing a closed mouth of the puppet in accordance with the present invention.
Figure 5:
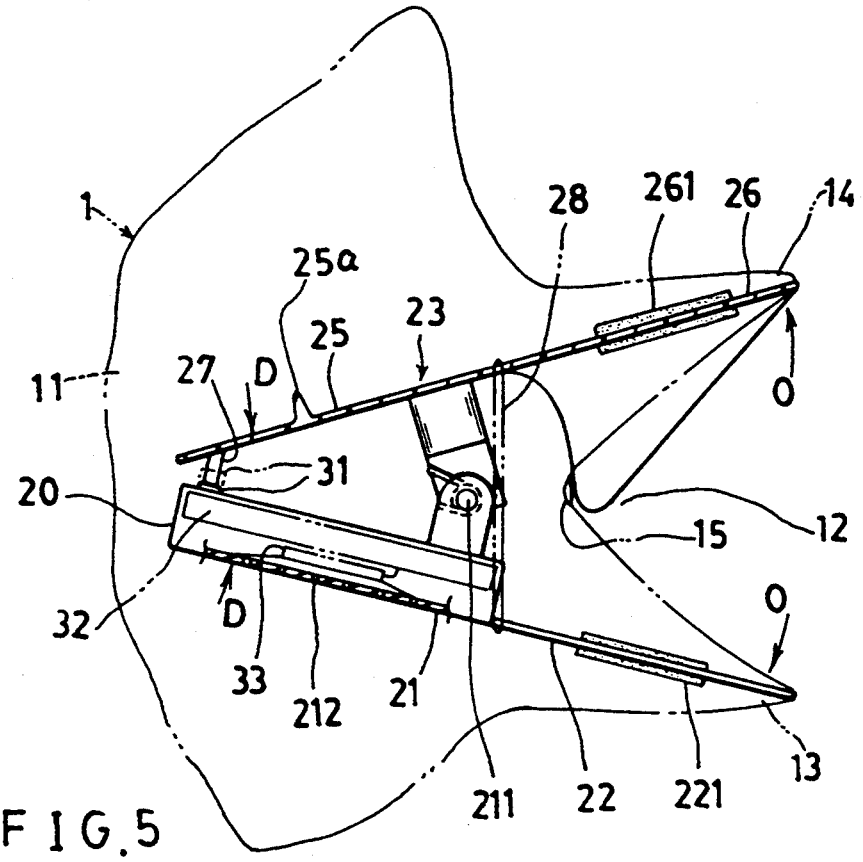
FIG. 5 shows an open mouth of the puppet of the present invention.

When using the present invention for opening the mouth portion 12 as shown in FIGS. 5 and 4, the player's fingers F and the thumb T respective hold and depress (D) the upper depression portion 25 of the finger-operated member 23 and the base portion 21 to bias the maxilla plate portion 26 upwardly (0) from the mandible plate portion 22 for opening the upper-jaw sheath 14 from the lower-jaw sheath 13 and opening the mouth portion 12. Simultaneously, the knob portion 27 on the bottom of the depression portion 25 will depress the trigger switch 31 downwardly (FIG. 5) to trigger and start the operation of the integrated circuit 32 for producing sound such as to mimic an animal cry or singing through the speaker 33 for greatly enhancing a player's interest when playing the puppet glove.

Upon releasing of the depression on the depression portion 25 and the base portion 21, the restoring spring 28 will restore the maxilla plate portion 26 to close the mandible plate portion 22 to raise the upper depression portion 25 ready for next repeatable depression operation.

The present invention may be modified without departing from the spirit and scope of this invention.

I claim:

1. A sound generating hand puppet comprising: a puppet glove (1) adapted to be worn by a player's hand, having a lower-jaw sheath (13) adapted to be worn by the player's thumb and an upper-jaw sheath (14) adapted to be worn by the player's fingers, both said sheaths (13, 14) pivotally formed on a head portion (10) of the puppet glove (1) to define a mouth portion (12) between the two sheaths (13, 14), and a throat (15) formed in a central portion of the mouth portion (12); a mouth manipulating means (2) including: a thumb-operated base portion (21) having a mandible plate portion (22) protruding forwardly from the base portion (21) to be embedded in the lower-jaw sheath (13) of the puppet glove (1) and having a housing (20) secured with the base portion (21), a finger-operated member (23) pivotally secured to the thumb-operated base portion (21) and having an upper depression portion (25) formed on a rear portion of the finger-operated member (23) and having a maxilla plate portion (26) protruding forwardly from the upper depression portion (25) to be embedded in the upper-jaw sheath (14), a knob portion (27) protruding downwardly from a rear bottom portion of the upper depression portion (25) of the finger-operated member (23), and a restoring spring (28) resiliently retained between the maxilla plate portion (26) and the mandible plate portion (22) for normally restoring the maxilla plate portion (26) to be closed upon the mandible plate portion (22) for normally closing the upper-jaw sheath (14) on the lower-jaw sheath (13) for closing the mouth portion (12) of the puppet glove (1); and a sound generating means (3) mounted in said housing (20) and including: a trigger switch (31) resiliently mounted on the housing (20), a sound-producing integrated circuit (32) electrically connected to the trigger switch (31) and reclaimed with a sound for imitating an animal cry, singing and a human voice, a power source for energizing said integrated circuit (32), and a speaker (33) electrically connected to the sound-producing integrated circuit (32) for producing the sound as pre-programmed in the integrated circuit (32); whereby upon depressing on the upper depression portion (25) to bias the maxilla plate portion (26) and the upper-jaw sheath (14) upwardly from the mandible plate portion (22) and the lower-jaw sheath (13) for opening the mouth portion (12), the knob portion (27) on the finger-operated member (23) will depress the trigger switch (31) of the sound generating means (3) for producing sound when opening the mouth portion (12) simultaneously.

2. A hand puppet according to claim 1, wherein said finger-operated member (23) includes a pair of lugs (24) formed on two opposite side portions of a middle portion of the finger-operated member (23) to be pivotally securable with a pair of pins (211) formed on two opposite side portions of the thumb-operated base portion (21) for pivoting the finger-operated member (23) on the thumb-operated base portion (21).

3. (amended) A hand puppet according to claim 1, wherein said mandible plate portion (22) is secured with the lower-jaw sheath (13) by a first fastening means (221); and the maxilla plate portion (26) is secured to the upper-jaw sheath (14) by a second fastening means (261).

4. A hand puppet according to claim 1, wherein said restoring spring (28) is an elastic band fastening the maxilla plate portion (26) with the mandible plate portion (22) for normally closing the mouth portion (12) of the puppet glove (1).

* * * * *